US009366056B2

(12) United States Patent
Nedwell

(10) Patent No.: US 9,366,056 B2
(45) Date of Patent: Jun. 14, 2016

(54) DECODING TUMBLER LOCKS

(71) Applicant: Jeremy Nedwell, Bishop's Waltham Hampshire (GB)

(72) Inventor: Jeremy Nedwell, Bishop's Waltham Hampshire (GB)

( * ) Notice: Subject to any disclaimer, the term of this patent is extended or adjusted under 35 U.S.C. 154(b) by 120 days.

(21) Appl. No.: 14/379,919

(22) PCT Filed: Feb. 15, 2013

(86) PCT No.: PCT/GB2013/050358
§ 371 (c)(1),
(2) Date: Aug. 20, 2014

(87) PCT Pub. No.: WO2013/124628
PCT Pub. Date: Aug. 29, 2013

(65) Prior Publication Data

US 2015/0040413 A1 Feb. 12, 2015

(30) Foreign Application Priority Data

Feb. 20, 2012 (GB) ..... 1202818.9

(51) Int. Cl.
*E05B 19/20* (2006.01)

(52) U.S. Cl.
CPC ..... *E05B 19/205* (2013.01)

(58) Field of Classification Search
CPC ..... E05B 19/205
USPC ..... 33/540
See application file for complete search history.

(56) References Cited

U.S. PATENT DOCUMENTS 2,338,768 A * 1/1944 Johnstone ..... E05B 19/205 33/540
4,535,546 A * 8/1985 Smith ..... E05B 19/205 33/540
5,172,578 A * 12/1992 Bitzios ..... E05B 19/20 33/540

(Continued)

FOREIGN PATENT DOCUMENTS

EP 2025840 A1 2/2009
WO WO 9820218 A1 * 5/1998 ..... E05B 19/205

OTHER PUBLICATIONS

Copy of International Search Report for PCT Application No. PCT/GB2013/050358, dated May 22, 2013, 3 pp.

(Continued)

*Primary Examiner* — Christopher Fulton
(74) *Attorney, Agent, or Firm* — Westman, Champlin & Koehler, P.A.

(57) ABSTRACT

In order to determine the particular cut possessed by a tumbler of a mechanical lock, the tumbler is stimulated with mechanical energy. The vibrational response of the tumbler is detected, and the detected response is used in determining which of the possible cuts the tumbler possesses. The cut of a lock tumbler is defined by its shape and/or size. For example, in the case of a pin tumbler lock, the cut of a pin is defined by its length. Different cuts of tumbler will therefore exhibit different vibrational responses to stimulation by mechanical energy, and these different vibrational responses can be used to determine which cut the tumbler possesses, for example by comparing with the vibrational responses of real or modeled tumblers with known cuts. The tumbler may be stimulated by an impulse of mechanical energy, and, after stimulating the tumbler, the vibrational response of the tumbler may be detected over a period of time.

16 Claims, 3 Drawing Sheets

(56) References Cited

U.S. PATENT DOCUMENTS 5,224,365 A * 7/1993 Dobbs ..... E05B 19/205 33/540
5,355,701 A * 10/1994 Tobias ..... E05B 19/205 70/352
6,722,172 B2 * 4/2004 Pinkhasov ..... E05B 19/205 33/540
7,243,437 B1 7/2007 Estrada
2003/0159480 A1 8/2003 Pinkhasov et al.
2011/0067254 A1 3/2011 Randall
2011/0071776 A1 * 3/2011 Andle ..... G01N 29/036 702/54

OTHER PUBLICATIONS

Copy of Written Opinion of International Search Report for PCT Application No. PCT/GB2013/050358, dated May 22, 2013, 6 pp.

* cited by examiner

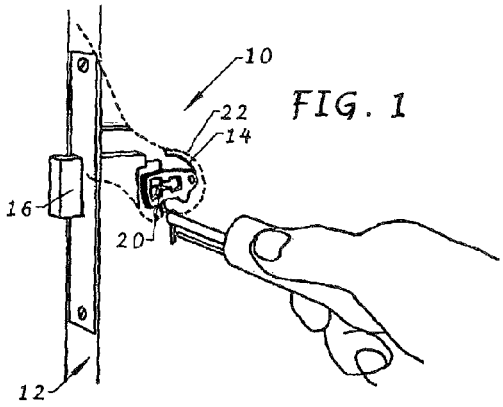
FIG. 1
FIG. 2
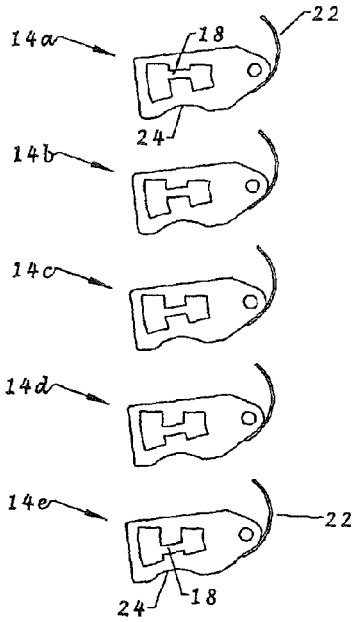
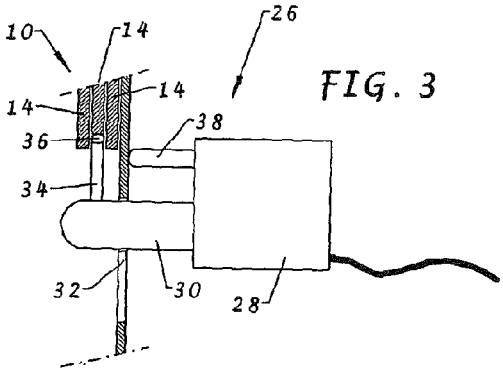
FIG. 3

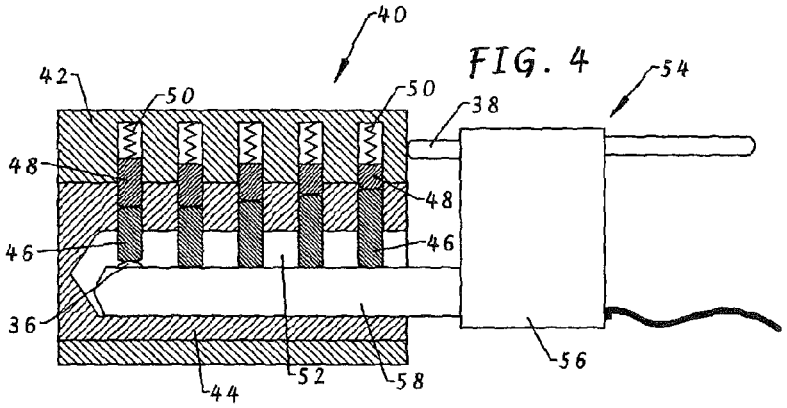
FIG. 4
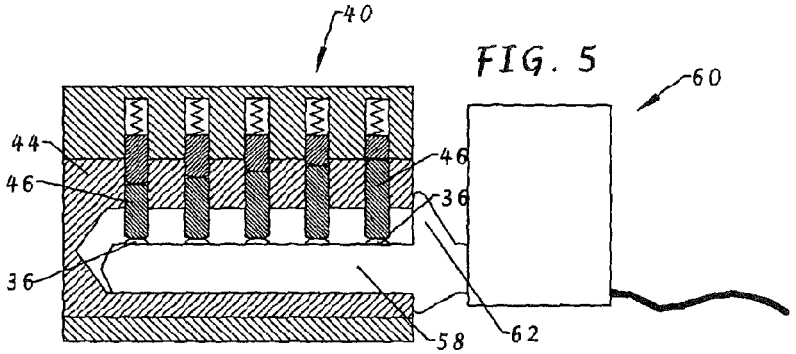
FIG. 5
FIG. 6
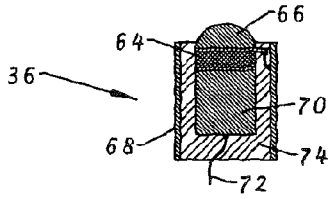
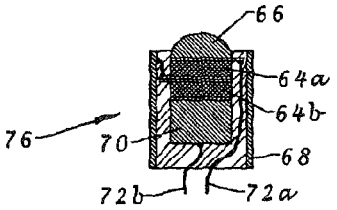
FIG. 7

DECODING TUMBLER LOCKS

CROSS-REFERENCE TO RELATED APPLICATION

This Application is a Section 371 National Stage Application of International Application No. PCT/GB2013/050358, filed 15 Feb. 2013 and published as WO 2013/124628 A1 on 29 Aug. 2013, in English, the contents of which are hereby incorporated by reference in their entirety.

This invention relates to a method, apparatus and transducer for use in determining the cut of a mechanical lock or of a tumbler in a mechanical lock.

The invention is applicable to a mechanical lock which is arranged to be unlocked by a key. In order to do this, first the key must be of a design which can be inserted into the lock. Second the key must have the correct 'cut' so that when fully inserted into the lock it moves at least one tumbler (but usually between three and nine tumblers) in the lock each to a position in which the lock can be released. Each tumbler has one of several possible cuts, typically between three and ten cuts. The combination of the particular cuts of the tumblers and the order in which they are arranged in the lock defines the cut of the lock, and the cut of the key needs to complement the cut of the lock in order that the key will work. Locks are usually designed so that it is not possible to read the cut of the lock by external visual inspection.

There are occasions when a lock needs to be lawfully unlocked but none of the keys for that lock is available, for example because they have all been lost. In this case, an attempt may be made by a skilled locksmith to pick the lock. If successful, the lock can then usually be replaced, or the lock can be disassembled so that its cut can be determined and the lock can be re-keyed. However, some locks are extremely difficult, or impossible, to pick. If a complete range of possible keys for a lock is available, each of them may be tried in the lock in turn until a key that works is found. However, the number of possible cuts of key for a particular design of lock may be very high, of the order of ten thousand, a hundred thousand, a million or more, and so in most cases this is an impracticable method. As a last resort, it may be necessary to break the lock or the structure to which it is fitted.

An aim of the invention, or least of specific embodiments of it, is to enable the cut of a locked lock to be determined without the need to pick the lock and without the need for dismantling the lock so that, for example, a key with a complementary cut can be manufactured and the lock can be unlocked.

The invention is applicable to many different types of lock, including pin-, wafer-, disc- and lever-tumbler locks.

In accordance with a first aspect of the present invention, there is provided a method of determining a particular cut possessed by a tumbler of a mechanical lock, the particular cut being one of a plurality of possible cuts. The method comprises the steps of: stimulating the tumbler with mechanical energy; detecting the vibrational response of the tumbler to the stimulation; and processing the detected response in determining which cut of the plurality of possible cuts the tumbler possesses.

The cut of a tumbler is defined by its shape and/or size. For example, in the case of a pin-tumbler lock, the cut of a pin is defined by its length. Different cuts of tumbler will therefore exhibit different vibrational responses to stimulation by mechanical energy, and these different vibrational responses can be used to determine which cut the tumbler possesses, for example by comparing with the vibrational responses of real or modelled tumblers with known cuts.

In a preferred embodiment of the invention, the tumbler is stimulated by an impulse of mechanical energy, and, after stimulating the tumbler, the vibrational response of the tumbler is detected over a period of time.

The method preferably includes the steps of: storing, for each possible cut, at least one reference time-domain response time history for that cut; producing from the detected response a detected time-domain response time history for the tumbler; and comparing the detected time history with the reference time history. In this case, each comparing step may use an algorithm which produces a quality-of-match value dependent on the quality of match between the detected time history and the respective reference time history; and the cut of the tumbler may be determined from which reference time history produces the best quality-of-match value. The quality-of-match value for each reference time history is preferably weighted in favour of peaks in the detected time history which match peaks in that reference time history. The quality-of-match value for each reference time history is also preferably weighted against peaks in the detected time history which do not match peaks in that reference time history and/or against peaks in that reference time history which do not match peaks in the detected time history. Each of the reference time histories is preferably normalised to a constant overall value prior to this matching, and the method may further comprise the step of normalising the detected time history prior to comparison with the stored time histories.

The stimulating step preferably comprises: providing a driving transducer which moves in response to an electrical driving signal; driving the driving transducer with an electrical pulse; and transmitting the resultant movement of the driving transducer to the tumbler.

The detecting step preferably comprises: providing a detecting transducer which generates an electrical detection signal in response to movement of the detecting transducer; and transmitting the vibrational response of the tumbler to the detecting transducer.

The driving transducer and the detecting transducer may be separate devices. However, a common transducer may conveniently serve as the driving transducer and as the detecting transducer.

The root mean square level of the detection signal is preferably used, and it may be smoothed over a short time period.

The invention extends, in a second aspect thereof, to a method of determining a cut of a mechanical lock having a plurality of tumblers each possessing one of a plurality of possible cuts. The method comprises the steps of performing the method of the first aspect of the invention on each of the tumblers. For a design of lock which is known other than its cut, once the cut of each of its tumblers has been determined, the cut of the lock as a whole and therefore of the required key can be determined.

A third aspect of the invention provides a transducer assembly for use in determining a particular cut possessed by a tumbler of a mechanical lock. The transducer assembly comprises: a shaft or blade for insertion into a keyhole of the lock; and at least one transducer mounted on the shaft or blade and arranged to stimulate the tumbler by an impulse of mechanical energy and to detect vibration of the tumbler. The transducer assembly may additionally include a gauge for gauging the depth to which the shaft or blade is inserted into the lock. When used with a lock having a plurality of tumblers, the shaft or blade can therefore be moved to align the transducer with the tumblers one after another. Alternatively, a plurality of such transducers may be provided arranged along the shaft or blade, and a register may be provided for engaging the lock and registering the transducer assembly with respect to the lock in the longitudinal direction of the shaft or blade so that the individual transducers become aligned with the individual tumblers.

In accordance with a fourth aspect of the invention, there is provided an apparatus for determining a cut of a tumbler of a mechanical lock. The apparatus comprises means for performing at least the stimulating step and the detecting step as defined for the method of the first aspect of the invention. At least part of the processing step of the method may be performed by a human operator. However, the apparatus may further comprise means for performing the processing step at least in part automatically. The apparatus preferably employs a transducer assembly according to the third aspect of the invention.

Specific embodiments of the present invention will now be described, purely by way of example, with reference to the accompanying drawings, in which:

FIG. 1 is a partly cut away view of a lever tumbler lock fitted to a door and a first embodiment of transducer assembly;

FIG. 2 shows a set of five possible cuts of lever tumbler which may be used in such a lock;

FIG. 3 is a schematic sectioned view through the lock and showing the transducer assembly;

FIG. 4 is a schematic sectioned view of a pin tumbler lock and a second embodiment of transducer assembly;

FIG. 5 is similar to FIG. 4, but showing a third embodiment of transducer assembly;

FIG. 6 is a schematic sectioned view of one arrangement of transducers that may be used in the transducer assemblies;

FIG. 7 is a schematic sectioned view of another arrangement of transducer that may be used in the transducer assemblies;

Figure 8:
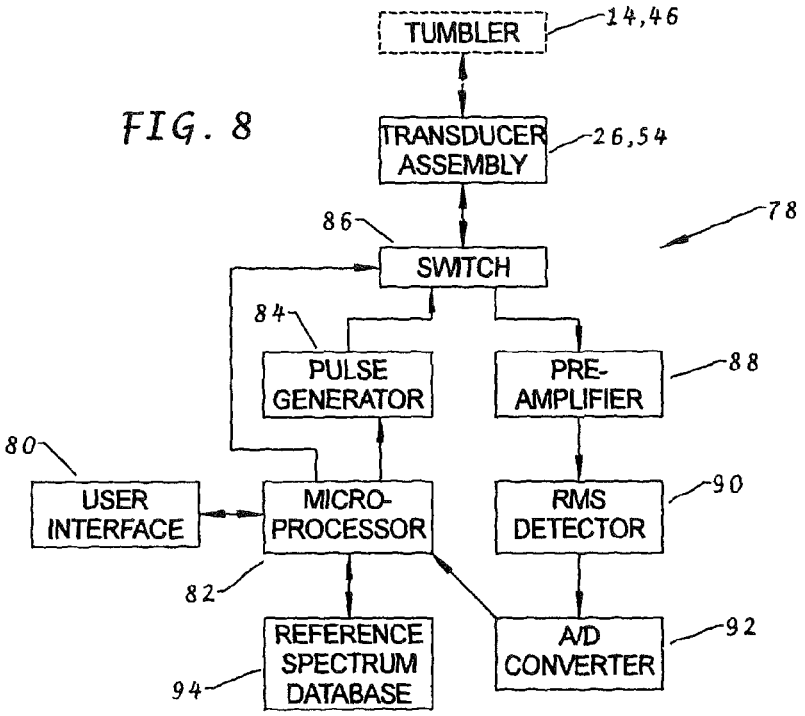
FIG. 8 is a block diagram of a lock cut determining apparatus according to the invention.

Referring to FIGS. 1 and 2, a lever tumbler lock 10 fitted to a door 12 has a set of three lever tumblers 14 which normally prevent a bolt 16 from moving. However, each tumbler 14 has a gateway 18 through which a projection 20 from the bolt 16 can pass if the tumbler 14 is raised, against the action of a leaf spring 22, a particular amount by a key bearing against the lower edge 24 of the tumbler 14. Each tumbler 14 is identical to one of a set of five tumblers 14*a-e* as shown in FIG. 2. The tumblers 14*a-e* are identical except that each has its gateway 18 at a different angular position. The tumblers 14*a-e* therefore need to be raised by differing amounts by the key in order to bring their gateways 18 horizontal so that the projection 20 on the bolt 16 can pass though them. This is what gives each of the tumblers 14*a-e* its different cut.

The invention utilises the effect that if each lever tumbler 14 of the lock 10 is stimulated mechanically at a position along its lower edge 24 that is accessible through the keyhole, then the tumbler 14 will respond differently in dependence upon which of the five cuts the tumbler 14 possesses. By detecting the response and comparing the response to predetermined reference responses for each of the five cuts of tumbler 14, it is possible to determine which cut that tumbler 14 possesses. Once the cuts of all of the tumblers 14 have been determined and the order of them, then if the model of lock is known, it is possible to manufacture a key that will fit the lock.

FIG. 3 shows a transducer assembly 26 for stimulating the tumblers 14 in turn. The assembly 26 comprises a body 28, a shaft 30 projecting from the body 28 so that it can be inserted through the keyhole 32 into the lock 10, and an arm 34 mounted on the shaft 30 so that it too can be inserted through the keyhole 32. The arm 34 radiates from the shaft 30 and has a transducer device 36 mounted at its tip so that when the shaft 30 is turned, for example through half a turn, the transducer device 36 can engage the lower edge 24 of one of the tumblers 14, depending on how far the shaft 30 has been inserted into the lock 10. To assist in setting or measuring the insertion distance, a depth gauge 38 is provided on the body 28.

Referring to FIG. 4, a different type of lock, namely a pin tumbler lock 40, is schematically shown having a body 42 and a cylindrical plug 44 fitted in the body 42. Five pairs of abutting pins 46,48 are a sliding fit in aligned holes in the body 42 and plug 44, and the pins 46,48 are urged inwards by springs 50 so that the inner tumbler pins 46 project into a keyway 52 and so that the outer driver pins 48 rest partly in the body 42 and partly in the plug 44. Although the total length of each pair of pins 46,48 is identical, the tumbler pins 46 can be of different lengths, as too can the driver pins 48. It is the length of each tumbler pin 46 that defines its cut. In the example shown, there are five different cuts of the tumbler pins 46. When a key (not shown) is fully inserted into the keyway 52 it raises each pair of pins 46,48 by individual amounts according to the cut of the key. If the keys fits, then the abutment line between each tumbler pin 46 and its driver pin 48 will line up with the outer surface of the plug 44 (the shear line), so that the plug 44 can then be turned in the body and operate an unlocking mechanism.

Again, the invention utilises the effect that if each tumbler pin 46 of the lock 40 is stimulated mechanically at its lower end that is accessible through the keyway 52, then the tumbler pin 46 will respond differently in dependence upon which of the five cuts the tumbler pin 46 possesses. By detecting the response and comparing the response to predetermined reference responses for each of the five cuts of tumbler pin 46, it is possible to determine which cut that tumbler pin 46 possesses. Once the cuts of all of the tumbler pins 46 have been determined and the order of them, then if the model of lock is known, or even if it is not, it is possible to manufacture a key that will fit the lock.

FIG. 4 also shows a transducer assembly 54 for stimulating the tumbler pins 46 in turn. The assembly 54 comprises a body 56 and a blade 58 projecting from the body 56 so that it can be inserted into the keyway 52. A transducer device 36 is mounted on the blade 58 so that it can engage the lower end of any one of the tumbler pins 46, depending on how far the blade 58 has been inserted into the lock 40. To assist in setting or measuring the insertion distance, a depth gauge 38 is provided on the body 56.

FIG. 5 shows an alternative transducer assembly 60 for stimulating the tumbler pins 46 of the lock of FIG. 4. In this case, a separate transducer device 36 is provided for each tumbler pin 46. A depth gauge 38 is therefore unnecessary, but the blade 58 is formed with a fixed register 62 which engages the end of the plug 44 of the lock 40 when the blade 58 is in its proper position.

The transducer device 36 used in the transducer assemblies 26,54,60 of FIGS. 3 to 5 may comprise an element 64 of a piezoelectric material, a magnetostrictive material, or another material which changes shape when a voltage or other signal is applied to it.

One design of transducer device 36 is shown in FIG. 6. In the simplest case, the element 64 is placed in contact with the tumbler 14,46, so that the vibration of the element 64 may be transferred to the tumbler 14,46 and vice versa. However, since this may cause wear of the element 64, and also to improve the transmission of energy, the vibration may be transferred between the element 64 and the tumbler 14,46 through a thin layer of compliant material and/or an anvil 66, or hard structure, attached to the outer face of the element 64, which is designed to couple movement efficiently between the transducer element 64 and the tumbler 14,46. As shown in FIG. 6, the device 36 has an electrically conductive tubular sleeve 68 to which a 'ground' electrode of the element 64 is bonded, and an electrically conductive backing mass 70 which is bonded to the 'signal' electrode of the element 64 and also provides a connection for a signal cable 72. The element 64 and backing mass 70 are potted in the sleeve 68 by a non-conductive material 74 such as plastic or rubber which may additionally serve to insulate the element 64 from the shaft 30 or blade 58 of the transducer assembly 26,54,60.

Another design of the transducer device 76 is shown in FIG. 7. In this case, there are two transducer elements 64*a,b*, namely a receiving transducer element 64*a* immediately underneath the anvil 66, and a transmitting transducer element 64*b* sandwiched between the receiving element 64*a* and the backing mass 70. The abutting electrodes of the elements 64*a,b* are electrically bonded to the ground sleeve 68, and separate receiving and transmitting signal cables 72*a,b* are electrically connected to the other electrode of the receiving element 64*a* and to the backing mass 70.

An apparatus 78 for use in determining the cut of the lock 10,40 using a transducer assembly 26,54 with a transducer device 36 is shown schematically in FIG. 8. In response to a command from a user interface 80, a microprocessor 82 is programmed to trigger a pulse generator 84 to generate a voltage pulse and also to control a switch 86 so that the voltage pulse is passed from the pulse generator 84 to a transducer element 64 of a transducer device 36 (as described with reference to FIG. 6) in the transducer assembly 26,54. As a result, the tumbler 14,46 in contact with the transducer device 36 is stimulated by an impulse of mechanical energy. Immediately after the voltage pulse has finished, the microprocessor 82 controls the switch 86 so that the transducer element 64 is connected to the input of a preamplifier 88 which amplifies the voltage signal that it receives and passes it to a root-mean-square detector circuit 90. The circuit 90 produces as an output a voltage signal which is the RMS level of the input signal, optionally smoothed over a short period of time. This RMS signal is then converted to a digital signal by an A to D converter 92, and a stream of samples of the digital signal are input to the microprocessor 82. The microprocessor 82 is then programmed to perform any of a number of operations on the received data stream, such as storing it, representing it in graphical form to the user interface 80, and/or processing it and data in a reference time history database 94 so as to determine which cut is possessed by the tumbler 14,46 under test, as will be described in more detail below. The above process is then repeated for each of the other tumblers 14,46 in the lock 10,40.

The pulse provided by the pulse generator is preferably a fixed voltage pulse of short duration, for example of about 0.01 microseconds, and as a result the tumbler 14,46 under test receives a mechanical impulse. The response of a tumbler 14,46 of a lock to such an impulse over a period of time after the impulse will typically be complex, and dependent on the detailed structure of the tumbler. However, it will be appreciated that for two tumblers 14,46 of identical cut, the vibrational behaviour of both will be identical, within the limits of manufacture. However two different tumblers 14,46 will generally produce different vibrational behaviours. Thus, if the vibrational behaviour of the various tumblers 14,46 of different cuts for a particular design of lock are previously recorded, or estimated using a suitable modelling programme, the unknown cut of a lock under test may be determined by comparison of the vibrational behaviour to the set of known behaviours.

Figure 9:
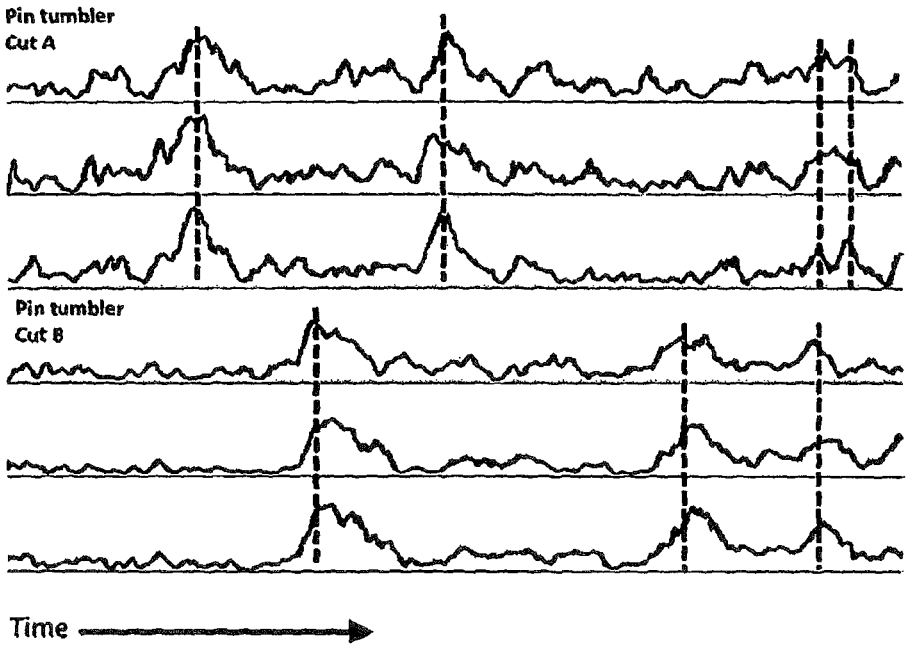
FIG. 9 shows sample signal time histories that may be acquired by the apparatus.

FIG. 9 shows the outputs of the A to D converter 92 as a function of time after the stimulation pulse for six tumbler pins 46. The upper three traces (or time-domain response time histories) are for pins of one cut, and the lower three time histories are for another cut. As can be seen, the time histories for pins which have the same cut are very similar However, the time histories for pins having different cuts are dissimilar. Hence, where a reference set of time-domain response time histories have been acquired for a particular lock type and all permissible cuts and therefore permissible pin lengths, having at least one example of each cut but preferably many, it is possible to determine the cut of an unknown lock by comparing the time-domain response time histories of the unknown pins within it to the reference set of time histories. By finding the cut of each pin that matches most closely to the known reference cuts, the cut of that pin may be determined.

In the simplest case, a trained operator of the apparatus 78 might simply recognise the response time history of a cut from previous experience. However, it is preferable to aid the operator in recognising the cut by visually comparing the response time history of the unknown cut against each reference time history. For instance, the reference and unknown time histories may be overlaid on the same graph, to determine whether the peaks, troughs, and other features of the reference and unknown time histories are similar. These features may be used by the operator to visually determine which reference cut matches the unknown cut best.

Alternatively, it is possible for the microprocessor 82 to use a suitable algorithm to compare the time history for the unknown pin and the reference time histories automatically. For instance, the unknown time history may be correlated against each of the reference time histories, to find the reference time history that provides the best match.

It should be noted that where the reference time histories have dissimilar levels, for instance if the contact between the transducer and the pin was better in one case than another when the signal was acquired, a matching algorithm may tend to favour a pulse having the highest level. Therefore, in order to compare the unknown time history more accurately and select those that offer the best matches, it is beneficial to normalise at least the reference time histories first, in order to bring the average amplitude of them all to the same level. For instance, in producing a normalised reference time history, the RMS signal output from the A to D converter 92 can be normalised by dividing it by the overall root mean square level of the entire time history for that time history. In other words, if a digital unnormalised reference time history is made up of N data points having values U(i) for I=1 to N, then the corresponding N data points having values R(i) in the normalised time history can be calculated as:

$$R(i) = \frac{U(i)}{\sum_{j=1}^{j=N} U(j)}$$

One suitable algorithm to find the quality of match Q between the N-point root mean square time history X(i) for an unknown tumbler and a normalised reference time history R(i) is given by:

$$Q=\Sigma_{i=1}^{i=N} X(i)\cdot R(i)$$

Thus, the microprocessor 82 multiplies each i-th point in the unknown time history by the corresponding point in the reference time history, and sums the values over all N point pairs. It will be appreciated that where peaks in both the reference and unknown time-domain time histories coincide, a high value will be multiplied by a high value and its addition to the quantity Q will be high, thus making it to tend to a large value. Where the peaks do not coincide, Q will be correspondingly low as in general a high value will be multiplied by a low value at each point. Thus, if the quantity Q is calculated using the unknown time history and for all of the reference time histories, it may be used to select the best match by determining the reference time history that yields the highest value of Q.

It may be noted that whereas this algorithm provides a high value for peaks that coincide, it does not provide a penalty when a peak occurs in the reference time history that does not exist in the unknown time history, and vice-versa. It may therefore be beneficial to use an algorithm which ensures that the match is the best possible, by not only ensuring that peaks in the unknown time history coincide with peaks in the reference time history, but also that no peaks exist in the unknown time history that are not matched by peaks in the reference time history and vice-versa. For instance, the degree of existence $W_1$ of unmatched peaks in the unknown time history when compared with the reference may be estimated by:

$$W_1 = \sum_{i=1}^{i=N} \frac{X(i)}{R(i)}$$

Similarly, the degree of existence $W_2$ of unmatched peaks in the reference time history when compared with the unknown time history is given by:

$$W_2 = \sum_{i=1}^{i=N} \frac{R(i)}{X(i)}$$

Thus, a corrected value of the quality of match Q' that penalises for unmatched peaks is given by $$Q' = A \cdot Q - B \cdot W_1 - C \cdot W_2$$

where A, B and C are constants determined by experiment to give the best match.

Various modifications and developments may be made to the embodiments of the invention described above.

For example, it will be appreciated that the matching algorithms are provided by means of example, and there are many other algorithms which might be used to match the detected and reference time histories. The use of analysis systems such as neural networks may provide better matching.

Also, in the apparatus 78 of FIG. 8, instead of using a transducer device 36 (FIG. 6) in the assembly 26,54, a transducer device 76 (FIG. 7) may be employed. In this case, the switch 86 is omitted, and the output of the pulse generator 84 is directly connected to the transmitting element 64*b*, whereas the input to the preamplifier 88 is directly connected to the receiving element 64*a*.

It should be noted that the embodiments of the invention has been described above purely by way of example and that many other modifications and developments may be made thereto within the scope of the present invention.

The invention claimed is:

1. A method of determining a particular cut possessed by a tumbler of a mechanical lock, the particular cut being one of a plurality of possible cuts, the method comprising the steps of:

stimulating the tumbler by an impulse of mechanical energy;

detecting, over a period of time, the vibrational response of the tumbler to the stimulation; and processing the detected response in determining which cut of the plurality of possible cuts the tumbler possesses.

2. A method as claimed in claim 1, and including the steps of:

storing, for each possible cut, at least one reference time-domain response time history for that cut;

producing from the detected response a detected time-domain response time history for the tumbler, and comparing the detected time history with the reference time histories.

3. A method as claimed in claim 2, wherein:

each comparing step uses an algorithm which produces a quality-of-match value dependent on the quality of match between the detected time history and the respective reference time history; and the cut of the tumbler is determined from the one or more reference time histories which produces the best quality-of-match value.

4. A method as claimed in claim 3, wherein:

the quality-of-match value for each reference time history is weighted in favor of peaks in the detected time history which match peaks in that reference time history.

5. A method as claimed in claim 3, wherein:

the quality-of-match value for each reference time history is weighted against peaks in the detected time history which do not match peaks in that reference time history and/or against peaks in that reference time history which do not match peaks in the detected time history.

6. A method as claimed in claim 2, wherein:

each of the reference time histories is normalized.

7. A method as claimed in claim 2, further comprising the step of:

normalizing the detected time history prior to comparison with the stored time histories.

8. A method as claimed in claim 1, wherein:

the stimulating step comprises:

providing a driving transducer which moves in response to an electrical driving signal;

driving the driving transducer with an electrical pulse; and transmitting the resultant movement of the driving transducer to the tumbler.

9. A method as claimed in claim 8, wherein:

the detecting step comprises:

providing a detecting transducer which generates an electrical detection signal in response to movement of the detecting transducer; and transmitting the vibrational response of the tumbler to the detecting transducer.

10. A method as claimed in claim 9, wherein:

a common transducer serves as the driving transducer and as the detecting transducer.

11. A method as claimed in claim 9, wherein:

a root mean square level of the detection signal is used.

12. A method as claimed in claim 9, wherein:

a smoothed root mean square level of the detection signal is used.

13. A transducer assembly for use in determining a particular cut possessed by a tumbler of a mechanical lock, the transducer assembly comprising:

a shaft or blade for insertion into a keyhole of the lock; and at least one transducer mounted on the shaft or blade and arranged to stimulate the tumbler by an impulse of mechanical energy and to detect vibration of the tumbler.

14. A transducer assembly as claimed in claim 13, further including:

a gauge for gauging the depth to which the shaft or blade is inserted into the lock.

15. A transducer assembly as claimed in claim 13 for use in determining a cut of a mechanical lock, wherein:

a plurality of such transducers is provided arranged along the shaft or Wade.

16. A transducer assembly as claimed in claim 15, further including:

a register for engaging the lock and registering the transducer assembly with respect to the lock in the longitudinal direction of the shaft or blade.

* * * * *